US005415401A

United States Patent [19]

Nagasaka

[11] Patent Number: 5,415,401

[45] Date of Patent: May 16, 1995

[54] MOVABLE BODY REBOUNDING MECHANISM FOR AMUSEMENT DEVICES

[75] Inventor: Yoshizo Nagasaka, Tokyo, Japan

[73] Assignee: Tomy Company, Ltd, Tokyo, Japan

[21] Appl. No.: 124,757

[22] Filed: Sep. 22, 1993

[30] Foreign Application Priority Data

Sep. 25, 1992 [JP] Japan ..... 4-280787

[51] Int. Cl.[6] ..... A63F 7/00

[52] U.S. Cl. ..... 273/110; 273/109; 273/148 R; 273/119 R; 273/129 R

[58] Field of Search ..... 273/108, 109, 110, 113, 273/115, 118-121, 123, 124, 129 R

[56] References Cited

U.S. PATENT DOCUMENTS

| | | | |
|---|---|---|---|
| 2,658,755 | 11/1953 | Benak | 273/110 |
| 2,791,428 | 5/1957 | McDonald | 273/110 |
| 3,479,033 | 11/1969 | Crisafulli et al. | 273/110 |
| 3,643,952 | 2/1972 | Sprowl | 273/110 |
| 3,841,636 | 10/1974 | Meyer | 273/110 |
| 4,248,427 | 2/1981 | Vierimaa . | |
| 4,335,878 | 6/1982 | Nishimiya . | |

*Primary Examiner*—Raleigh W. Chiu

*Attorney, Agent, or Firm*—Staas & Halsey

[57] ABSTRACT

A movable body rebounding mechanism has a rocking plate, a plurality of projecting members and a rocking mechanism. The movable body rebounding mechanism is for use in amusement devices in which a movable body moves on an upper side of a game board having upper and lower sides. The projecting members project from the rocking plate to the lower side of the game board, through holes formed in the game board and out of the upper side of the game board. A clearance exists between the holes in the game board and the projecting members. The rocking mechanism reciprocates the rocking plate parallel to the game board in at least first and second directions. The rocking mechanism includes a drive mechanism for eccentrically rotating a first pin which projects through a hole in the rocking plate. There is little clearance between the first pin and the hole in the rocking plate. The drive mechanism further includes a second pin positioned stationary with respect to the game board. The second pin projects through a slot formed in the rocking plate. The slot is spaced away from, in a spacing direction, the hole through which the first pin projects. The slot is aligned in the spacing direction.

8 Claims, 9 Drawing Sheets

MOVABLE BODY REBOUNDING MECHANISM FOR AMUSEMENT DEVICES

BACKGROUND OF THE INVENTION

1. Field of the Invention

The present invention relates generally to a game device having a movable body, for example, a ball, which is moved along a game board, and more particularly, to a movable body rebounding mechanism for automatically rebounding the movable body after it collides with the rebounding mechanism.

2. Description of the Related Art

Movable body rebounding mechanisms in general are known in the related art. An example of such a rebounding mechanism is a bumper mechanism of a pinball game such as that disclosed in Examined Japanese Patent Publication No. SHO 56-26428. FIGS. 9 and 10 show the construction of this type of bumper mechanism. As shown in these figures, a bumper mechanism 101 includes a pair of upper and lower disk-like bumper pieces 102*a* and 102*b* projecting from a game board 103, wherein the lower bumper piece 102*b* has a diameter larger than that of the upper bumper piece 102*a*.

The upper bumper piece 102*a* is formed integrally with both a leg portion 108 extending vertically downwardly from a lower surface of the upper bumper piece 102*a* and a supporting frame 109 horizontally extending on both sides of the leg portion 108. The supporting frame 109 is rockably supported at one end thereof through a pin 110, and is biased upward near its center by a spring 111. On the end of the supporting frame 109 opposite the pin 110, a stopper 112 is provided, which stopper 112 abuts the lower surface of the game board 103 for limiting the upper position of the upper bumper piece 102*a*. A rack 113 is also provided on the supporting frame 109 opposite pin 110. The rack 113 is formed in a circular-arc recessed surface around the pin 110 so as to be meshed with a planetary gear 114 described later.

The lower bumper piece 102*b* is formed integrally with a supporting frame 115. The supporting frame 115 restricts the size of the bumper piece 102*b* so that the two are in close contact. The supporting frame 115 is pivotally supported at one end thereof with a shaft 117, and is biased upward near its center by a spring 118. The supporting frame 115 is also formed with an expanding slit 120 through which the leg portion 108 of the upper bumper piece 102*a* passes. Further, on the end of the supporting frame 115 opposite shaft 117, there is provided a stopper 119 thereby limiting the upper position of the lower bumper piece 102*b*. A claw portion 122 is provided on the same side of the supporting frame 115 as the stopper 119. The claw portion 122 is removably engaged with a stopper 124 formed on the side of a frictional disk 123 which will be described later.

The bumper mechanism 101 further includes a motor 125 which is usually rotated at a constant speed, the motor 125 serving as a drive source for the upper bumper piece 102*a*. The motor 125 is connected to a sun gear 129 through reduction gears 126 and 127, and a shaft 128. The frictional disk 123 is biased toward the sun gear 129. This biasing is done with a clutch spring 131 abutting the side of the frictional disk 123 which has stopper 124 formed thereon. Further, a planetary gear 114 is rotatably provided on the frictional disk 123. Planetary gear 114 meshes with the sun gear 129 and the rack 113 of the supporting frame 109.

A description follows of how the bumper mechanism 101 having the above construction rebounds a ball 107 which is rolled along the game board 103 and collides with bumper mechanism 101. When the ball 107 collides with the bumper mechanism 101, the ball 107 first contacts the lower bumper piece 102*b* (which has a larger diameter). The weight of the ball 107 immediately forces the lower bumper piece 102*b* downward against the biasing force of the spring 111. When the downward displacement of the lower bumper piece 102*b* reaches a specified value, the claw portion 122 of the lower bumper piece 102*b*, which was previously engaged with the stopper 124 of the frictional disk 123, is disengaged from stopper 124. This disengagement allows the frictional disk 123 to be rotated together with the sun gear 129. The rotational force is provided by the frictional force between the sun gear 129 and the frictional disk 123 resulting from the biasing force of the clutch spring 131. Along with the rotation of the frictional disk 123, the planetary gear 114 revolves in a clockwise direction (according to the vantage of the figures) and meshes with the rack 113 of supporting frame 109 of the upper bumper piece 102*a*. Accordingly, the supporting frame 109 is rotated counterclockwise (according to the vantage of the figures) around the pin 110. As a result, the upper bumper piece 102*a* is drawn down to clamp the ball 107 in contact therewith. The ball 107 is clamped between the upper and lower bumper pieces 102*a* and 102*b*. Because of the slanted surfaces of the bumper pieces, the ball 107 is rebounded from the bumper mechanism 101.

After rebounding the ball 107, the lower bumper piece 102*b* is returned to its original position by the spring 118. When the frictional disk 123 rotates further and the meshing between the rack 113 of the supporting frame 109 and the planetary gear 114 is released, the upper bumper piece 102*a* is returned to the original position by the spring 111. With further rotation of the frictional disk 123, stopper 124 engages with the claw portion 122 of the lower bumper piece 102*b* against which the stopper 124 is already in the stand-by condition. This returns the mechanism to its original stage. With the above operation, the bumper mechanism 101 can repeatedly rebound the ball 107 which collides therewith.

However, as is evident from the above description, the related art bumper mechanism has a large number of parts and has a very complicated construction, for example, it requires a planetary gear. In general, a game device usually has a plurality of bumper mechanisms having the above construction. Accordingly, the bumper mechanism increases the production cost, enlarges the size of the game device, and requires complex maintenance. For these reasons, the number and the placement of the bumper mechanisms are restricted. These disadvantages are particularly inconvenient for game devices which are simple and small (e.g., table-top sized) in terms of the manufacturing expense and space allocation.

SUMMARY OF THE INVENTION

In view of the above situation, the present invention has been made. It is an object of the present invention to provide a game device which reduces production costs, is smaller in size and simplifies maintenance. It is a further object to provide a game device which enables an increased number of the rebounding mechanisms and a greater degree of the freedom as to where the rebounding mechanisms can be placed. To achieve these goals, it is an object of the present invention to reduce the number of parts of the body rebounding mechanisms which are movable and to simplify the constructions.

To achieve the above objectives, according to the present invention, there is provided a game device in which a game is played by moving a movable body along a game board, the game device having an intermediate plate positioned on the underside of the game board. The present invention also has an intermediate plate which can be freely reciprocated at least in the longitudinal direction with respect to the game board (parallel to the game board). Projecting members for rebounding the ball are attached to the intermediate plate and project upwardly from the game board.

In this case, the above movable body preferably comprises a ball. Further, the intermediate plate is preferably constructed so as to be freely reciprocated in the longitudinal and lateral directions.

Preferably, the projecting members of the intermediate plate and the game board are conductive at least in the portions where they are adjacent to one another. Preferably, at least the surface of the movable body is formed of a conductive material. In this manner, the respective adjacent portions of the projecting members and the game board partially can constitute at least one of a counter circuit, a voice generation circuit and a light generation circuit. To do this the projecting members and game board would be energized with a different polarity from each other.

According to the above game device, since the intermediate plate is reciprocated with respect to the game board in the longitudinal direction and is formed with projecting members extending upwardly from the game board, when a movable body moving along the game board collides with the reciprocating projecting members, it is thus rebounding therefrom. Further, since the movable body may be a ball, the present invention can be used in, for example, a pinball game.

Since the intermediate plate may be reciprocated not only in the longitudinal direction but also in the lateral direction, it is possible to give variable, unpredictable movement to the movable body as it is rebounded by the projecting members. Hence interest in the game is increased. Furthermore, if certain of the game parts are conductive and energized when the movable body collides with the projecting members, current is conducted from the projecting members to the game board through the movable body. In doing so, at least one of the counter circuit, a voice generation circuit and light generation circuit may be actuated. This makes it possible to count the score, generate a voice or illuminate a light in correspondence with the movable body actuating the circuit.

DETAILED DESCRIPTION OF THE PREFERRED EMBODIMENTS

Hereinafter, a preferred embodiment of the present invention will be described in detail with reference to the drawings.

Figure 1:
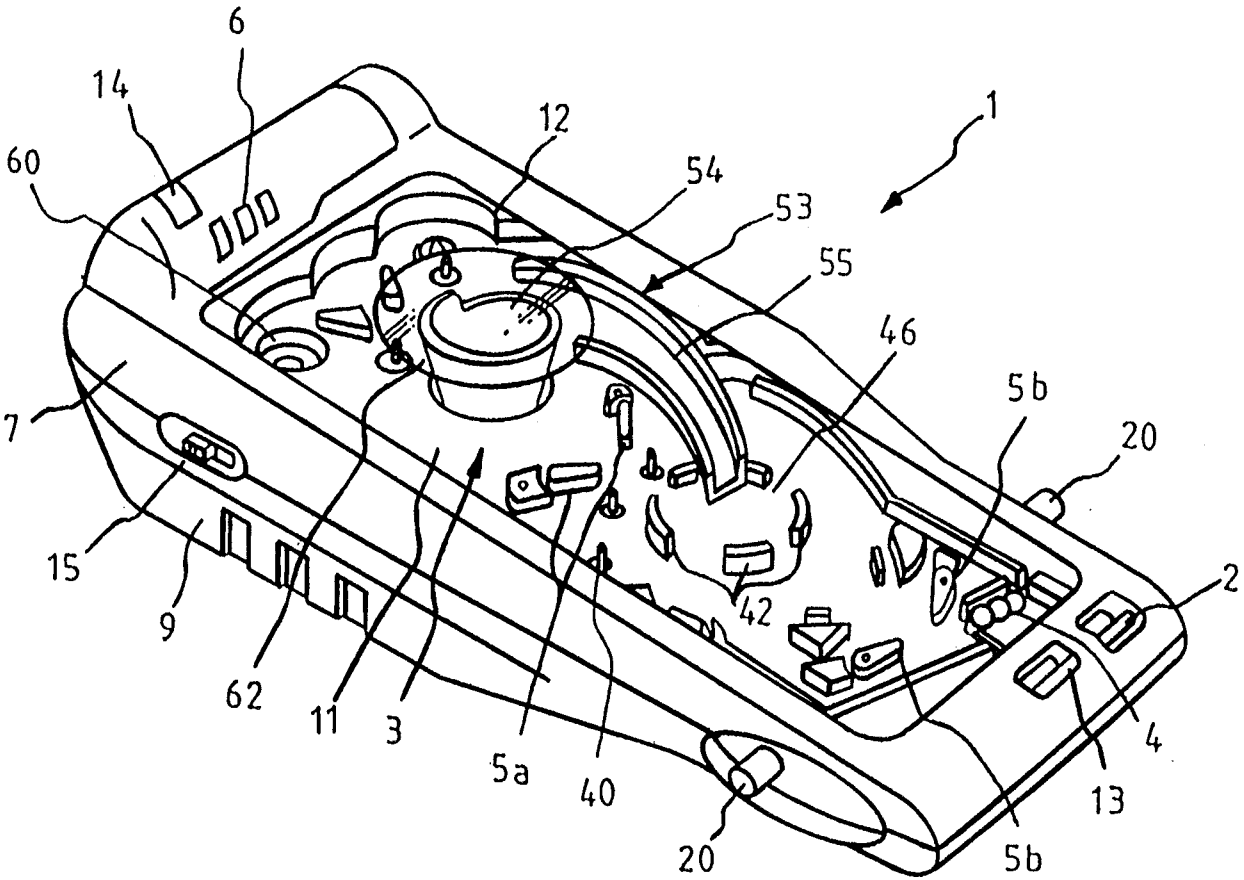
FIG. 1 is a perspective view showing the external appearance of a pinball game device according to the present invention.

FIG. 1 is a perspective view showing the external appearance of a pinball game device embodying the present invention. The pinball game device 1 is of a relatively small table top type, and operates as follows. First, a player propels a ball 4 by operating a discharge lever 2. The ball 4 then rolls on the game board 3. Upper and lower flippers **5*a*, 5*b* can be used to deflect the ball 4 from its course. In this case, whenever the ball 4 collides with a member on the game board 3, a counter 6 counts and displays a specified score. The game is based on achieving the highest total score. Further, in this game device 1, a jumping mechanism 53 having a conical member 54 and a ball passage 55 is provided on the game board 3 for jumping a ball 4 which is rolled to and received by jumping mechanism board 53**.

Figure 4:
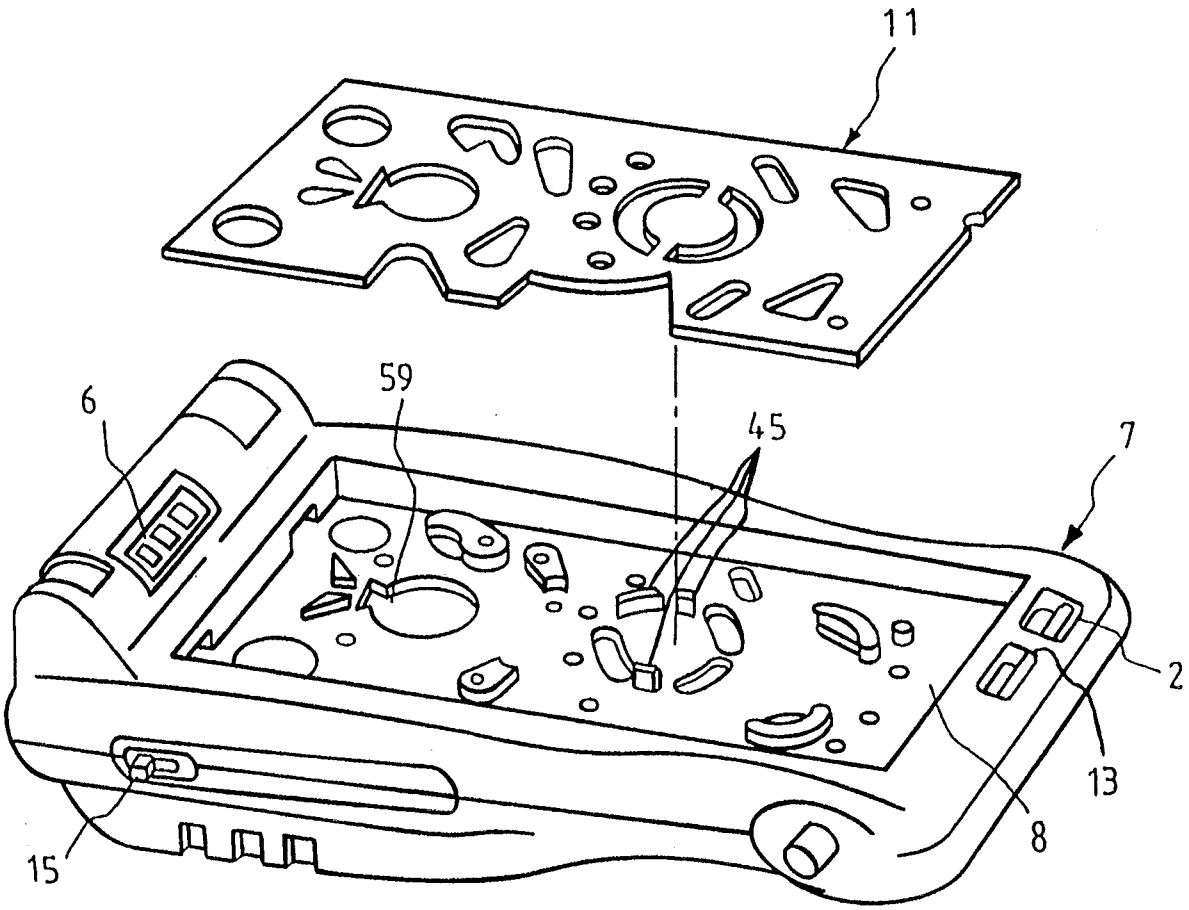
FIG. 4 is a perspective view showing the base, a main body and a surface layer plate.

The pinball game device 1 includes on its periphery an operating member, such as a discharging lever 2, and a counter 6. It further includes at its central portion a main body 7 formed of an inclined bottom plate 8 (see FIG. 4) constituting a game board 3; a base 9 (see FIG. 2) fixed on the underside of the main body 7; a surface layer plate 11 laid on the bottom plate 8 of the main body 7, which constitutes the game board 3 together with the bottom plate 8; and a transparent cover 12 made of, for example, plastic for covering the game board 3. The balls 4, each being made of steel, are contained within the main body 7. For example, there may be three balls.

The main body 7 is made of, for example, plastic. It includes, on its peripheral wall, a gate stopper 13 for preparing the balls 4 to be discharged by the discharging lever 2, the counter 6 (described above), a counter reset button 14 for resetting the counter 6 and a main switch 15. Holes are formed in the plate 8 and the surface layer plate 11 of the main body 7. The holes have shapes approximately similar to the elements (to be described later) formed on the rocking plate 10. The holes are formed at positions corresponding to the elements (see FIG. 4).

Figure 3A:
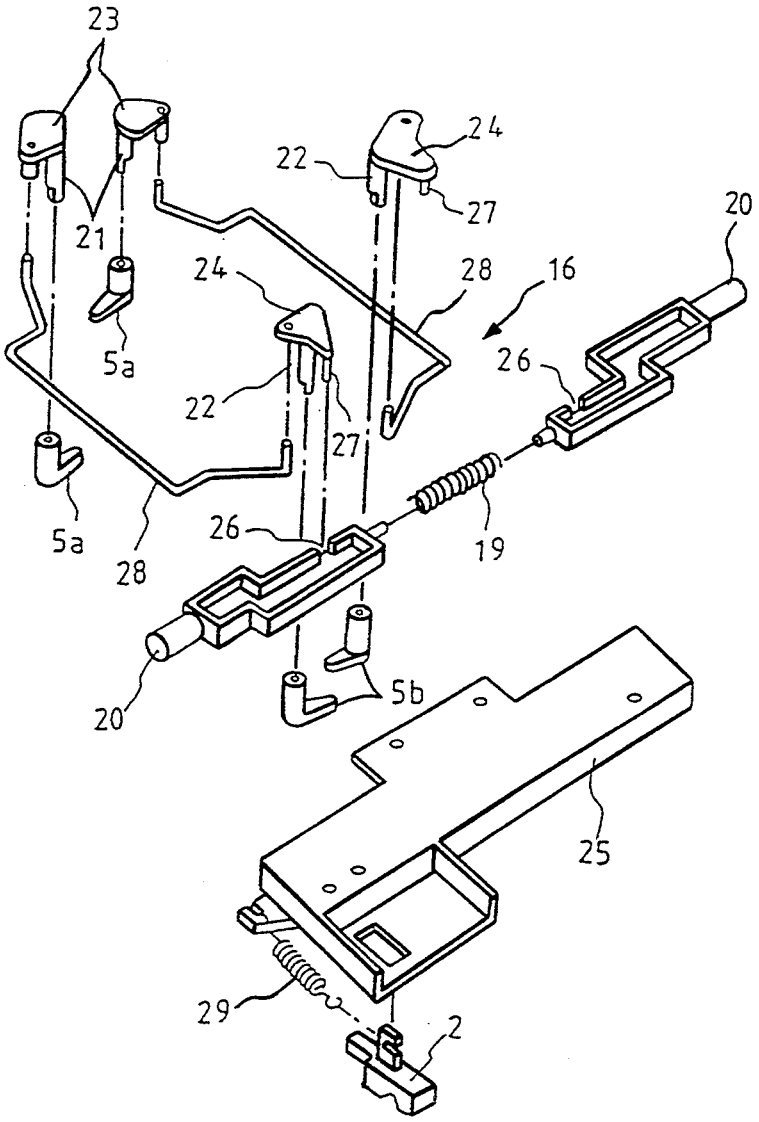
FIG. 3A is an exploded perspective view of flippers, a drive mechanism and associated elements.
Figure 3B:
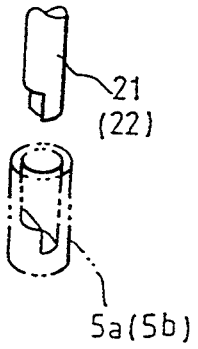
FIG. 3B is a perspective view showing how a shaft meshes with one of the flippers.

FIG. 3A shows from below the flippers **5*a*, 5*b*, and a drive mechanism 16. As shown in this figure, the flippers 5*a* and 5*b* are comprised of a pair of right and left upper flippers 5*a*, disposed at the central portion of the bottom plate 8, and a pair of right and left lower flippers 5*b* disposed to one side of the bottom plate 8. The drive mechanism 16 includes a pair of right and left flipper levers 20 disposed such that a spring 19 is connected therebetween. The drive mechanism also includes a pair of right and left upper flipper shafts 23 and a pair of right and left lower flipper shafts 24 which are rotatably mounted on the bottom plate 8 through shaft portions 21 and 22 respectively. The shaft portions 21 and 22 of the upper and lower flipper shafts 23 and 24 are respectively inserted in holes of the upper and lower flippers 5***a* and 5*b*. In this case, as shown in FIG. 3B, the stepped portions formed on the shaft portions and those in the holes of the flippers mesh with each other, which makes it possible to integrally rotate the upper and lower flippers 5*a* and 5*b*.

Each of the flipper levers 20 is supported on the main body 7 by a lever pressing frame 25. One end of each flipper lever 20 projects from a side (opposing sides) of the main body 7 to be operated by the player. A pin 27 of each lower flipper shaft 24 is engaged with a cut-out 26 formed on the flipper lever 20. The upper flipper shafts 23 are connected to lower connecting bars 28 engaged with the holes thereof. Each connecting bar is engaged with a hole on an upper flipper shaft and also with a hole on the lower flipper shaft. With the above construction, when the flipper levers 20 are pressed, the lower flipper shafts 24, which are engaged with the flipper levers 20, are turned around the shaft portions 22. The lower flippers 5*b*, which are integrated with the shaft portions 22, are thus turned, which makes it possible for them to rebound the ball 4. At the same time, the upper flipper shafts 23, which are connected to the lower flipper shafts 24 through the connecting bars 28, are integrally turned. The upper flipper shafts 23 thereby turn upper flippers 5*a* in a forward direction. In addition, the discharging lever 2 connected at one end with a spring 29 is contained in the lever pressing frame 25. The discharging lever 2 protrudes from the upper surface of the main body 7 at the right corner portion on this side for discharging the ball 4 by the bias force of the spring 29.

Figure 2:
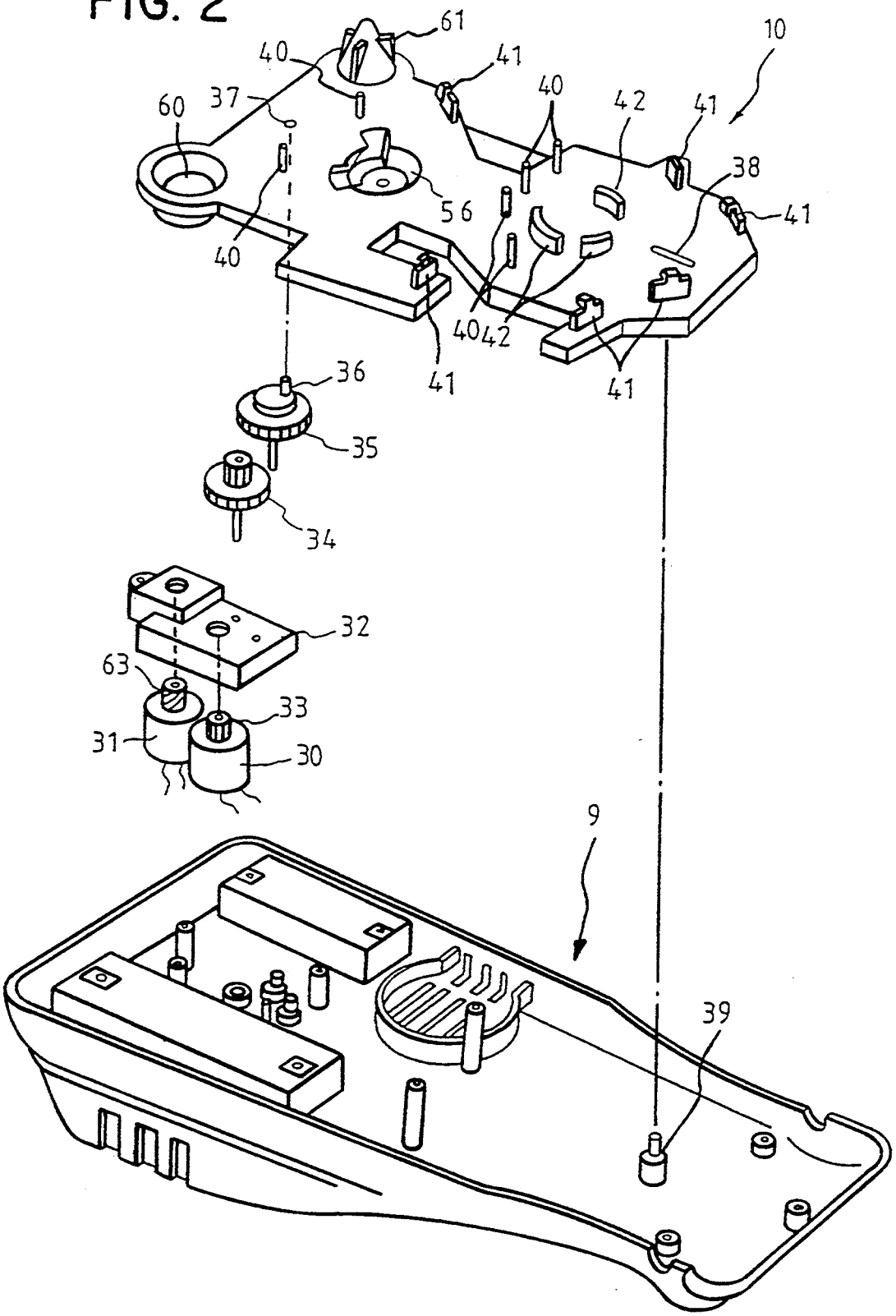
FIG. 2 is an exploded perspective view of a base, a rocking plate and associated elements.

As shown in FIG. 2, a motor 30 for rocking the rocking plate 10 and a motor 31 for operating the counter 6 are mounted on the base 9 by a mounting frame 32. Motors 30 and 31 are directed upward away from base 9. Two gears 34 and 35 are sequentially meshed with a pinion 33 of the motor 30, and a pin 36 is eccentrically provided on the upper surface of the gear 35. The pin 36 is engaged with a hole 37 formed at the central portion of the rocking plate 10 on the side which is away from the side where the ball 3 is discharged. On the other hand, a guide slot 38 extending in the longitudinal direction is formed at the central portion of the rocking plate 10 on a side which is opposite the hole 37 (towards where ball 4 is discharged) the guide slot 38 is engaged with a pin 39 projectingly provided on the base 9.

The rocking plate 10 is made of, for example, plastic. As shown in FIG. 2, six pins 40, six bumpers 41 and three lucky zone bumpers 42 are projectingly provided on the upper surface of the rocking plate 10. These pins 40, bumpers 41 and lucky zone bumpers 42 respectively pass through holes formed in both the bottom plate 8 and the surface layer plate 11 of the main body 7 to extend upwardly from the surface layer plate. The holes allow suitable clearance (have gaps) to account for movement of rocking plate 10. With this construction, when the ball 4 collides with these pins 40, bumpers 41 and lucky zone bumpers 42, the ball 4 is rebounded by the rocking action of the rocking plate 10.

Each pin 40 is made of a conductive metal material. The lower ends of the pins 40 are fixedly buried in the rocking plate 10. As shown in FIG. 7, each bumper 41 has a plastic rectangular supporting plate 43 formed integrally with the rocking plate 10 and a metal contact plate 44 mounted on the supporting plate 43. The lucky zone bumpers 42 are intended to define a circular lucky zone 46 (see FIG. 6) on the game board 3 together with surrounding walls 45 formed integrally with the bottom plate 8 of the main body 7. These lucky zone bumpers 42 and the surrounding walls 45 are positioned such that gaps exist therebetween to allow the ball 4 to pass therethrough. Each lucky zone bumper 42 has a plastic circular-arc supporting plate 47 formed integrally with the rocking plate 10. Two of the supporting plates 47 on this side are each mounted with metal contact plates 48 (see FIG. 6).

Figure 5:
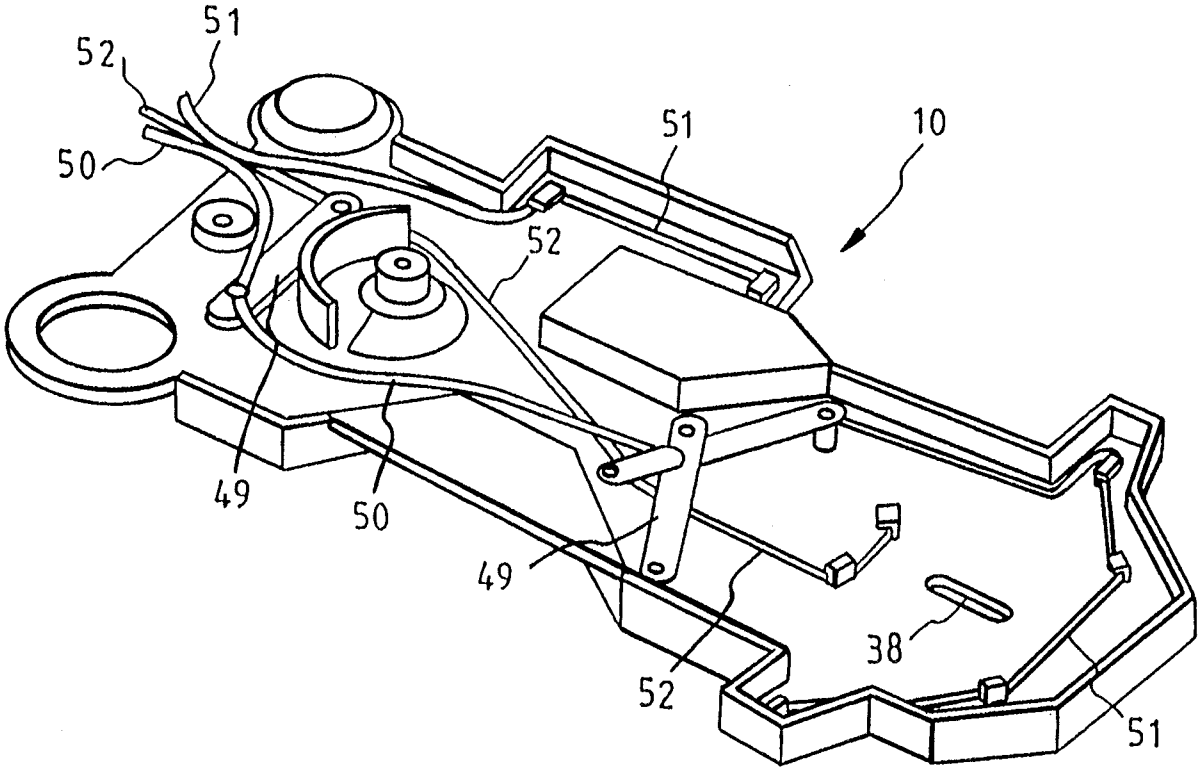
FIG. 5 is a perspective view showing a connecting structure on the back surface of the rocking plate.

As shown in FIG. 5, connections are made between the pins 40, between the contact plates 44 of the bumpers 41, and between the contact plates 48 of the lucky zone bumpers 42. The connections are made on the back surface of rocking plate 10 and are made by a connecting cord 50, a connecting cord 51 and a connecting cord 52, respectively. Metal plates 49 aid in the connections. The connecting cords 50, 51 and 52 partially constitute each of a counter circuit, a voice generation circuit and a light generation circuit (not shown). These circuits also include a power supply. The cords 50, 51 and 52 are intended to energize the pins 40, the contact plates 44 and the contact plates 48, respectively.

The surface layer plate 11 is a conductive metal plate, for example an iron plate. The surface layer plate 11 is also part of the counter circuit, the voice generation circuit and the light generation circuit. The surface layer plate 11 is energized with a polarity different from that of the pins 40 and contact plates 44 and 48. Portions of upper surface of the surface layer plate 11 are coated with a decorative paint of a specified design. However, non-coated portions 64, adjacent to the pins 40, the bumpers 41 and the lucky zone bumpers 42 of the rocking plate 10 are not coated.

Figure 6:
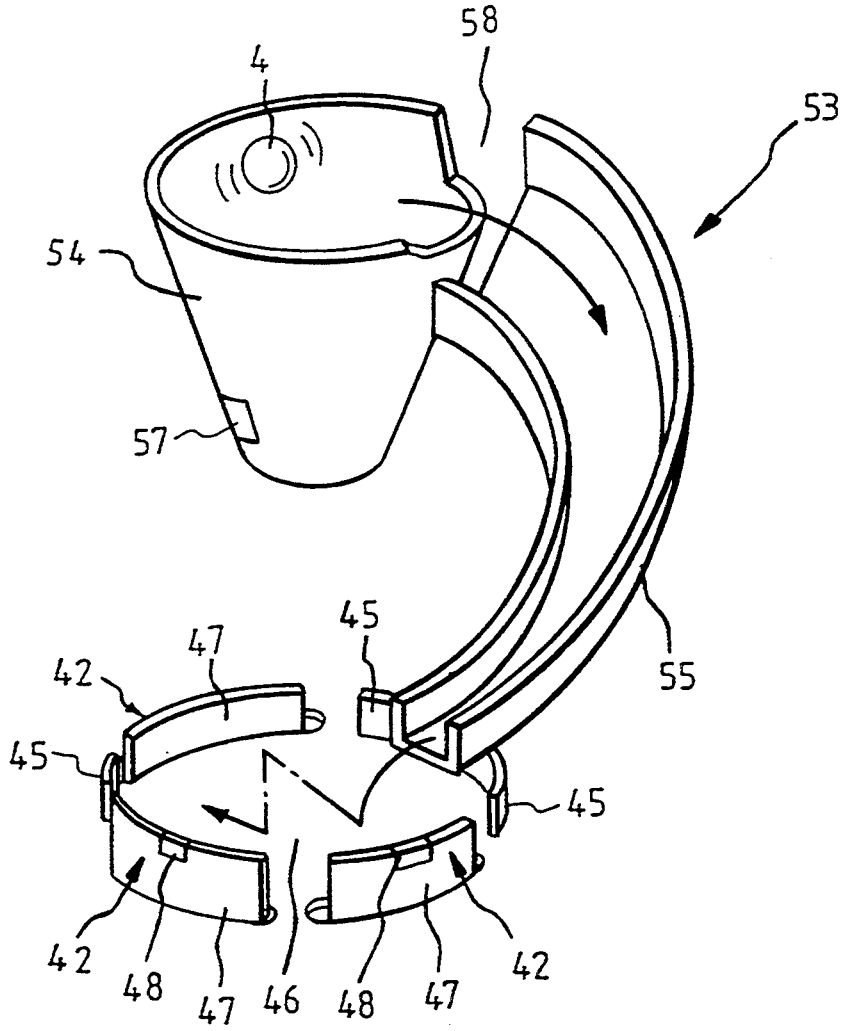
FIG. 6 is a perspective view of a jumping mechanism for moving a ball.
Figure 7:
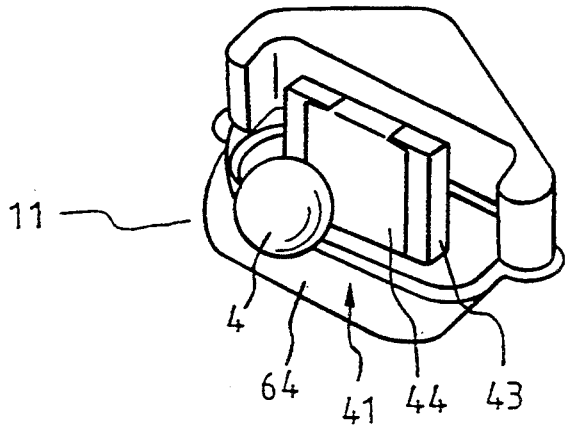
FIG. 7 is a perspective view showing a ball colliding with a bumper.

As shown in FIG. 6, a jumping mechanism 53 for jumping the ball 4 is provided at the center of the game board 3 on the side opposite where the ball 4 is discharged. The jumping mechanism 53 has a conical member 54 and a ball passage 55. The conical member 54 has a lower end portion screwed in the bottom of a mounting hole 56 formed on the rocking plate 10. The conical member 54 also has an upper half portion which projects upwardly from the bottom plate 8 and the surface layer plate 11 of the main body 7. In addition, a prism label (not shown) for generating the operative light is located on the inner surface of the rear wall of the mounting hole 56.

As shown in FIG. 6, an opening which serves as a ball inlet 57 is formed on the central portion on the side most distant from where the ball 4 is released from the conical member 54. On the other hand, the upper end portion of the side wall of the conical member 54 is partially cut-out to serve as a ball outlet 58. On the bottom plate 8 (see FIG. 4) of the main body 7, a guide groove 59 for guiding the ball 4 to the ball inlet 57 is formed at a position adjacent to the ball inlet 57. The ball passage 55 is formed of, for example, a transparent plastic and has a trough shape. The ball passage 55 is inclined such that one end (upper end) faces the ball outlet 58 and the other end (lower end) faces the lucky zone 46. In addition, the transparent cover 12 has a spherical dome portion 62 positioned to accommodate the conical member 54 (see FIG. 1). Reference numeral 60 in FIG. 2 indicates a recessed portion for temporarily holding the ball 4 dropped therein and then feeding it onto the game board 3. Reference numeral 61 represents a blade portion projectingly formed to irregularly rebound the ball 4 which collides therewith.

The operation of the pinball game device 1 having the above construction will now be described. First, when the main switch 15 is turned on, the motor 30 for driving the rocking plate 10 is rotated. Through rotation of the motor 30, the rocking plate 10 is rocked. Pins 36 and 39 serve to guide rocking plate 10, as the hole 37 is engaged with the eccentrically rotating pin 36 and slot 38 is engaged with the pin 39 of the base 9. The rocking plate 10 is thus reciprocated at a constant period and stroke in the longitudinal and the lateral directions with respect to the game board 3, and is rocked as a whole. Along with the rocking of the rocking plate 10, the pins 40, bumpers 41, lucky zone bumpers 42, conical member 54, recessed portion 60 and blade portion 61, which are all fixed on the rocking plate 10, are also rocked with respect to the game board 3. Further, when the main switch 15 is turned on, the pins 40, bumpers 41, lucky zone bumpers 42 and surface layer plate 11, as parts of the counter circuit, voice generation circuit and light generation circuit, are energized. The surface layer plate 11 is energized with a different polarity than the pins 40, bumpers 41 and lucky zone bumpers 42.

In such a state, when being discharged by the discharging lever 2, the ball 4 advances forward along the game board 3 and is possibly dropped in the recessed portion 60. The ball 4 is then returned to the game board 3 due to the centrifugal force and may be rebounded in an unexpected direction by the blade portion 61, and is rolled on this side along the game board 3. The ball 4 can be intentionally rebounded forward by a player with the flippers 5*a* and 5*b*, and may collide with the pins 40 and the bumpers 41 projecting from the game board 3. Pins 40 and bumpers 41 rock with respect to the game board 3, to thus automatically rebound ball 4.

Figure 8:
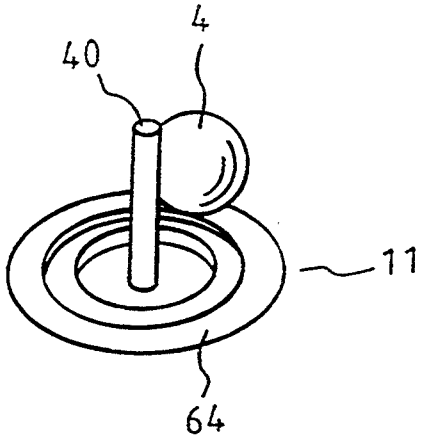
FIG. 8 is a perspective view showing a ball colliding with a pin.
Figure 9:
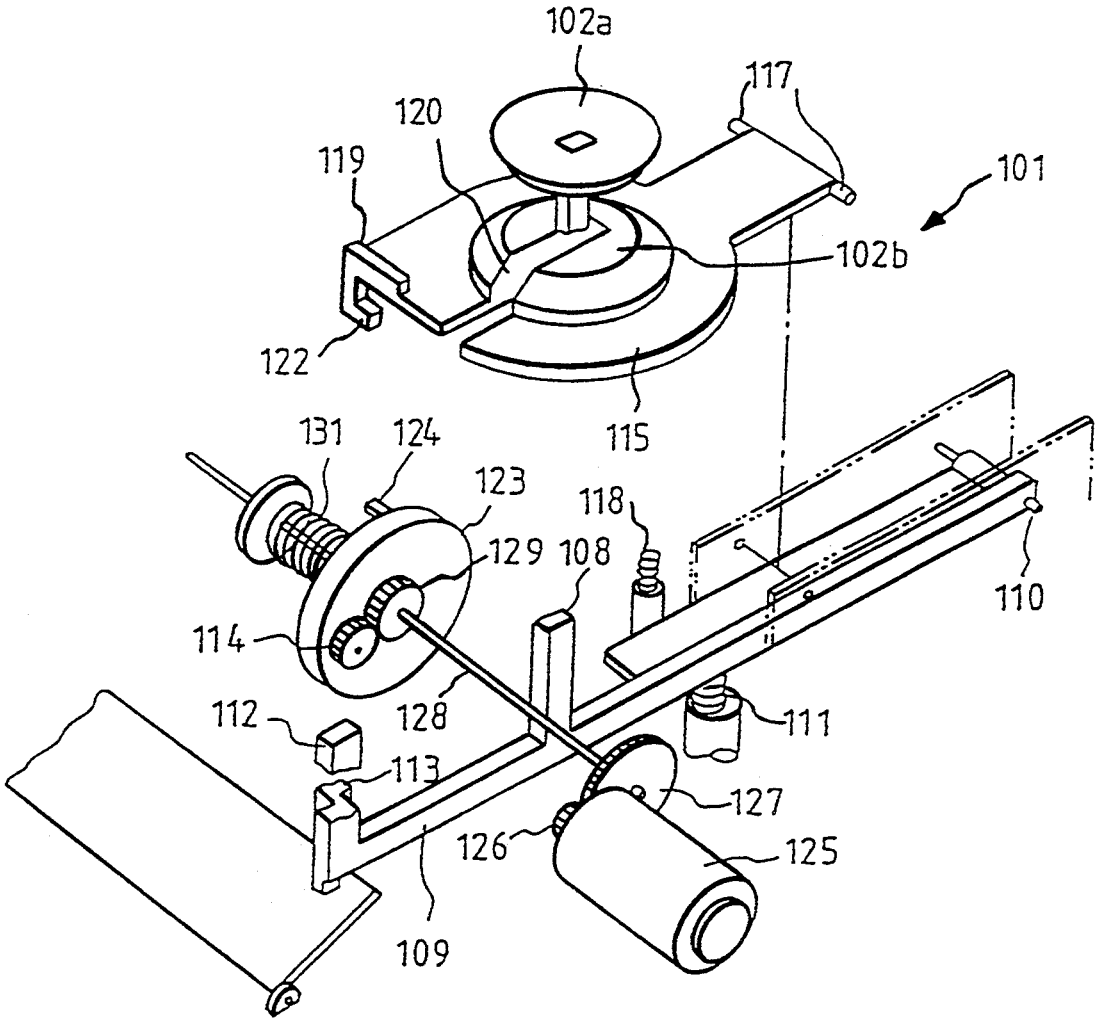
FIG. 9 is an exploded perspective view of a bumper mechanism of a pinball game using a related art ball rebounding mechanism.
Figure 10:
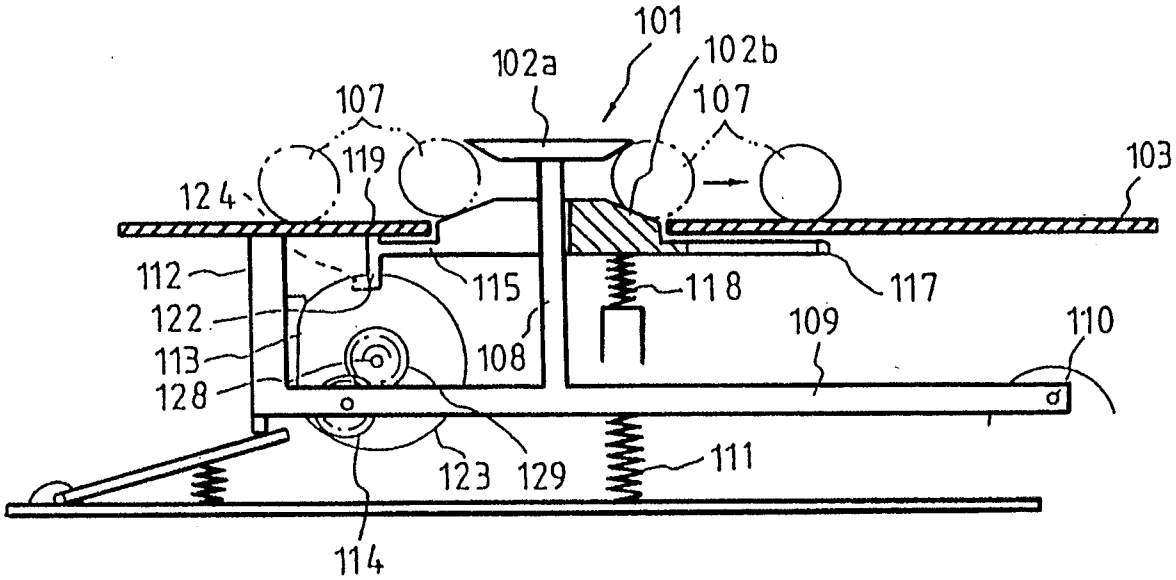
FIG. 10 is a sectional view of the bumper mechanism shown in FIG. 9.

In collision with the pins 40 and the bumpers 41, as shown in FIGS. 7 and 8, the steel ball 4 contacts pins 40 or contact plates 44 of the bumpers 41 and also simultaneously contacts the non-coated portions 64 of an adjacent portion of the surface layer plate 11. Thus, electrical conduction can occur. As a result of the conduction, the motor 31 is rotated to actuate the counter circuit, so that the counter 6 counts a score, for example one point, by means of a mechanical counter drive mechanism (not shown) meshing with a worm gear 63 of the motor 31. At the same time, the voice generation circuit and the light generation circuit are actuated to generate a specified operative sound and operative light. Thus, whenever the ball 4 collides with the pin 40 or the bumper 41 point(s) are scored, light is emitted and sounds are produced.

When the ball passes the ball inlet 57 of the conical member 54, the ball 4 is guided by the guide groove 59 formed on the bottom plate 8 of the main body 7, to enter the ball inlet 57 of the conical member 54. The ball 4, when in the conical member 54, is subjected to a centrifugal force from the rocking conical member 54. Thus, as shown in FIG. 6, the ball 4 is rolled and raised along the inner surface of the wall of the conical member 54, to eventually be flung away from the ball outlet 58 to exit the conical member 54. There is some probability that the ball 4 exiting will be received in the ball passage 55. In this case, the ball 4 will be fed to the lucky zone 46.

The ball 4 fed to the lucky zone 46 is repeatedly rebounded by the rocking lucky zone bumpers 42 until it is discharged from the lucky zone 46 through the gaps between lucky zone bumpers 47 and surrounding walls 45. As described above, the contact plates 48 provided on the two lucky zone bumpers are energized just as are the pins 40 and the contact plates 44 of the bumpers 41. Thus, whenever the ball 4 collides with the lucky zone bumpers 42, the score is incremented and the operative sound and operative light are produced. Accordingly, when the ball 4 enters the lucky zone 46, a high score can be obtained (because of the repeated collisions). In addition, the dimensional and positional relationships between the ball outlet 58 and the ball passage 55 determine the probability that the ball 4 flung away from the ball outlet 58 of the conical member 54 will be received by the ball passage 55 and deposited into the lucky zone 46. Consequently, by adjusting the dimensional and positional relationships, the probability that the ball 4 will enter the lucky zone 46 can be adjusted. This controls the difficulty in scoring.

As described above, the pins 40, bumpers 41 and lucky zone bumpers 42 each formed on the rocking plate 10 are constructed so as to be rockable with respect to the game board 3. Thus, when the ball 4 collides therewith, ball 4 is automatically rebounded. Accordingly, compared with the related art bumper mechanism using a planetary gear and the like, the present invention reduces the number of parts of the ball rebounding mechanism and significantly simplifies the construction. As a result, it is possible to reduce the production cost, to make the mechanism smaller in size, and to simplify the maintenance of the pinball game device. It is further possible to increase the number of the rebounding mechanisms and increase the degree of the freedom in positioning the rebounding mechanisms.

Further, since the rocking plate 10 may be reciprocated not only in the longitudinal direction, but also in the lateral direction, the rebounding direction and the rebounding force of the ball 4 are variously changed according to how and when the ball 4 collides with the pin 40 or the like. This makes the game more interesting. In addition, the steel ball 4 serves as the switch for actuating the counter circuit, voice generation circuit and light generation circuit. This enables score to be kept by the counter 6, and light and sound to be generated when the ball 4 collides with the pin 40 or the like.

In addition, the present invention can be used in various devices without limitation to the above-described embodiment. For example, the description has centered around a pinball game. However, the present invention can, of course, be used in other suitable ball game devices, and adapted to a game device which is played by sliding a short column-shaped movable body in place of the ball along the game board. The present invention may be applied to a large-sized pinball game device in addition to the small table top type described. The details of the construction may be further variously modified without departing from the spirit or scope of the present invention.

As described above, the game device of the present invention reduces production costs, makes smaller devices possible, and simplifies maintenance. Further, the present invention increases the possible number of rebounding mechanisms and increases the degree of the freedom as to where the rebounding mechanisms can be placed. These accomplishments are made by reducing the number of parts of the rebounding mechanism which are movable and by simplifying the construction.

I claim:

1. A game device, comprising:

a game board having upper and lower sides;

a rocking plate;

a plurality of projecting members projecting from the rocking plate to the lower side of the game board, through holes formed in the game board and out of the upper side of the game board, a clearance existing between the holes and the projecting members; and rocking means for reciprocating the rocking plate parallel to the game board in a generally circular motion.

2. A game device according to claim 1, wherein the plurality of projecting members includes an irregularly shaped projecting member having blades.

3. A game device according to claim 1, wherein the rocking plate has a recessed portion and the game board has a hole aligned with the recessed portion of the rocking plate, the recessed portion and the hole aligned with the recessed portion being large enough to accommodate a movable body.

4. A game device according to claim 1, wherein the movable body is a ball.

5. A game device, comprising:

a game board having upper and lower sides;

a rocking plate;

a plurality of projecting members projecting from the rocking plate to the lower side of the game board, through holes formed in the game board and out of the upper side of the game board, a clearance existing between the holes and the projecting members; and rocking means for reciprocating the rocking plate parallel to the game board in at least first and second directions, the rocking means comprising:

drive means for eccentrically rotating a first pin which projects through a hole in the rocking plate, there being little clearance between the first pin and the hole in the rocking plate; and a second pin positioned stationary with respect to the game board, the second pin projecting through a slot formed in the rocking plate, the slot being spaced away from, in a spacing direction, the hole through which the first pin projects, the slot being aligned in the spacing direction.

6. A game device according to claim 5, wherein the game device is a pinball game having first and second opposite ends with a ball releasing mechanism at the first end, the drive means, first pin and hole in the rocking plate being located in the vicinity of the second end, and the slot and second pin being located in the vicinity of the first end.

7. A game device according to claim 3, wherein each of the corresponding conductive portions form a switch mechanism together with the outer surface of the movable body, the switch mechanism being connected to at least one of a sound generation circuit, a light generation circuit and a score counter circuit.

8. A game device, comprising:

a movable body;

a game board having upper and lower sides, the upper side of the game board accommodating movement of the game body;

a rocking plate;

a plurality of projecting members projecting from the rocking plate to the lower side of the game board, through holes formed in the game board and out of the upper side of the game board, a clearance existing between the holes and the projecting members, the game board and the projecting members having corresponding conductive portions, the corresponding conductive portions being in the vicinity, but not contacting, one another, the distance from one conductive portion to the adjacent corresponding conductive portion being less than the width of the movable body, the movable body having at least an outer surface which is conductive; and rocking means for reciprocating the rocking plate parallel to the game board in at least first and second directions.

* * * * *